United States Patent [19]

Hong et al.

[11] 4,202,139

[45] May 13, 1980

[54] CONFORMABLE HAND SANDING PAD

[75] Inventors: In S. Hong, Hugo Township, Washington County; Glenn E. Roelofs, Oakdale, both of Minn.

[73] Assignee: Minnesota Mining and Manufacturing Company, Saint Paul, Minn.

[21] Appl. No.: 893,989

[22] Filed: Apr. 6, 1978

[51] Int. Cl.[2] ..... B24D 15/04

[52] U.S. Cl. ..... 51/393; 24/204

[58] Field of Search ..... 51/391, 392, 393, 401, 51/405, 406, 407; 15/227; 2/DIG. 6; 16/126; 24/204

[56] References Cited

U.S. PATENT DOCUMENTS

| | | | |
|---|---|---|---|
| 203,959 | 5/1878 | Townsend | 130/4 |
| 1,346,683 | 7/1920 | Reynolds | 2/168 |
| 1,562,414 | 11/1925 | McKnight | 51/371 |
| 2,071,365 | 2/1937 | Stroop | 15/227 |
| 2,396,548 | 3/1946 | Allen | 15/227 |
| 2,459,985 | 1/1949 | Woodbury | 2/161 R |
| 2,485,295 | 10/1949 | Larson | 206/447 |
| 2,644,280 | 7/1953 | O'Neil, Jr. | 51/406 |
| 2,765,593 | 10/1956 | Salmon et al. | 51/392 |
| 3,540,150 | 11/1970 | De Rose et al. | 51/391 |
| 3,638,284 | 2/1972 | Baker | 24/204 |
| 3,688,348 | 9/1972 | Kiotz et al. | 24/204 |
| 3,699,672 | 10/1972 | Sims | 15/227 |
| 3,849,949 | 11/1974 | Steinhauser et al. | 51/406 |
| 3,875,703 | 4/1975 | Clemente | 51/406 |
| 3,892,091 | 7/1975 | Hutchins | 51/392 |
| 3,912,142 | 10/1975 | Steinhauser et al. | 225/52 |
| 3,998,012 | 12/1976 | Ness | 51/391 |
| 4,038,787 | 8/1977 | Bianchi | 51/391 |

*Primary Examiner*—Harold D. Whitehead
*Assistant Examiner*—K. Bradford Adolphson
*Attorney, Agent, or Firm*—Cruzan Alexander; Donald M. Sell; Richard Francis

[57] ABSTRACT

A flexible, hand-held sanding pad comprises a conformable, self-supporting pad having one major surface capable of providing temporary adhesive attachment for a sheet of pressure-sensitive adhesive-coated abrasive material and a handle means for maintaining the pad in contact with the hand of the user during use.

5 Claims, 4 Drawing Figures

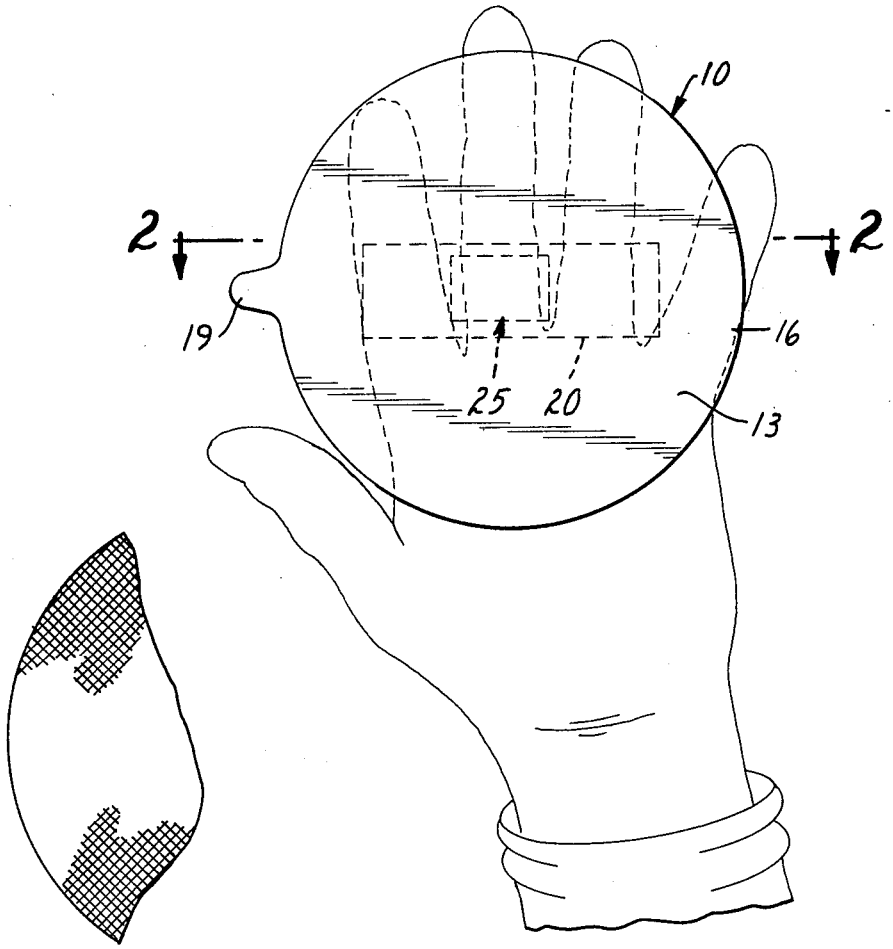
FIG. 4
FIG. 1
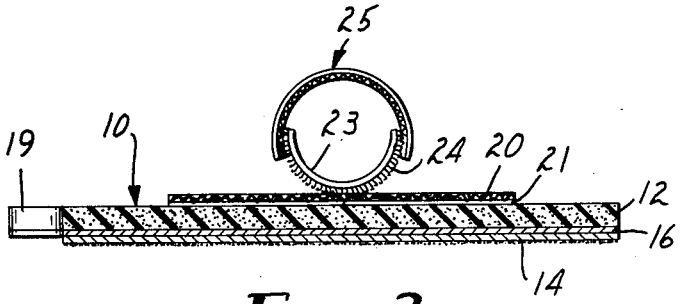
FIG. 2
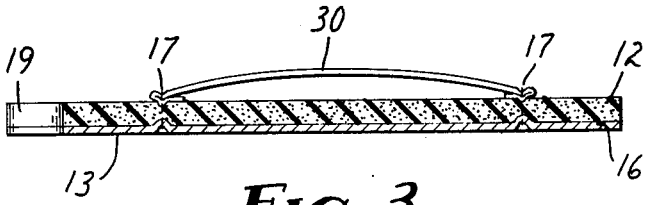
FIG. 3

CONFORMABLE HAND SANDING PAD

BACKGROUND OF THE INVENTION

1. Field of the Invention

This invention relates to an improved sanding pad for holding and supporting a sheet of coated abrasive sheet material during hand sanding operations.

2. Prior Art

Coated abrasive sheet materials are used in any of a wide variety of applications. Many applications require hand sanding where the user will grasp a coated abrasive sheet in his hand and apply it to the surface being treated. Such use has fostered numerous devices to assist in the holding of the coated abrasive sheet to avoid injuring the hand or fingers while maintaining the requisite position of and pressure on the coated abrasive sheet to its optimum effect. Improper positioning will cause uneven abrasion of the treated surface. Irregular pressure, such as caused by the fingers against the back side of the abrasive sheet in use, produces an irregular abraded surface.

Early holding devices used for this purpose were inflexible blocks of solid material such as wood over which the coated abrasive sheet was wrapped. While these devices were adequate for some purposes, they required some means of holding or attachment of the ends of the coated abrasive sheet while applying one face of the block against the surface being treated, thus not making the maximum efficient use of the paper since the ends are generally never exposed to the surface being treated. Various sanding blocks of this type employing means for grasping the ends of the abrasive sheet are known, for example as disclosed in U.S. Pat. Nos. 2,765,593 and 1,562,414. U.S. Pat. No. 1,562,414 discloses a similar hand block which requires at least a part of the block to be formed of a material which is somewhat flexible but sufficiently rigid to retain the ends of the abrasive sheet in slots cut therein.

There has been developed and marketed a self-adhering coated abrasive sheet material using pressure-sensitive adhesive coated on its back side so that it may be adhered directly to the working face of a sanding block. For the most part, this means of attachment assures exposure of the entire abrasive face of the abrasive sheet. Such abrasive sheets are disclosed in U.S. Pat. Nos. 2,485,295, 3,849,949 and 3,912,142. This type of abrasive sheet has been extremely useful in conjunction with hard sanding blocks such as the types mentioned above and for rotatable disc sanding heads.

While the rigid sanding blocks are useful for sanding flat areas or areas with moderate surface variation, such as curved parts with a large radius of curvature, great quantities of abrasive sheet material are still used on complex surfaces, such as carved patterns, curved parts having a smaller radius of curvature and the like, without a pad. There has been no acceptable sanding pad, prior to the present invention, which is sufficiently conformable to be used to sand complex surfaces and particularly which can use the new type of adhesive-coated abrasive sheet material.

There are numerous patents showing flexible abrasive devices in the form of gloves which are coated on the palm surface with abrasive material. Examples of these are shown in U.S. Pat. Nos. 203,959, 1,346,683, 2,459,985 and 4,038,787. While such devices are adequate for some purposes, they are not adequate for use in situations where uniform sanding pressure is required because of the non-uniformity of the pressure applied by the various parts of the hand. Additionally, because of their irregular surfaces, gloves do not provide an adequate surface upon which the new pressure-sensitive adhesive-coated abrasives may be applied. The gloves are also generally over-sized to fit a wide variety of hand sizes; thus motion during abrasion causes the fingers and palm to move in the glove with respect to the areas of abrasive, providing erratic abrading and often discomfort to the user.

SUMMARY OF THE PRESENT INVENTION

The present invention provides a novel improved sanding pad for holding and supporting a sheet of pressure-sensitive adhesive-coated abrasive material during hand sanding operations which overcomes the problems noted above. The sanding pad of the invention is ideally suited for use with pressure-sensitive adhesive-coated abrasive sheet material. The sanding pad of the invention also protects and insulates the hand during abrading operations, substantially preventing injury and discomfort caused by splinters, heat build up, abrasion of the fingers and/or hand, and from other sources.

The sanding pad of the present invention comprises a conformable, self-supporting pad which has one major surface capable of providing temporary adhesive attachment for a sheet of pressure-sensitive adhesive-coated abrasive material. The opposite major surface has a handle means for maintaining the pad in contact with the hand of the user during use.

The conformable, self-supporting pad is sufficiently conformable to permit the coated abrasive sheet to conform to irregular shapes such as corners, intricate round shapes such as may be found on spindles, and depressed and raised patterns on furniture or woodwork which may be provided by carving or embossing. The conformable, self-supporting pad has sufficient body and integrity to distribute the forces provided by the fingertips and palm surface to eliminate discontinuities caused by finger impressions.

The surface of the conformable pad upon which the pressure-sensitive adhesive-coated abrasive sheet is adhered provides for temporary adhesive attachment, permitting clean removal, yet securing the sheet firmly even during the most strenuous sanding operations.

The handle means provides a means of maintaining the pad in contact wth the hand of the user during use. A useful handle means may be provided by a fabric strap which is sewn at its ends on the back side of the pad. The preferred handle means is provided by at least three segments of hook- and loop-type fastening material, with one segment of this material fastened to the back side of the conformable pad and the other two forming a ring structure which will accommodate at least one finger of the hand of the user and will expose on its outer surface a segment of material which will engage the fastened strip to provide an attachable-detachable ring structure.

BRIEF DESCRIPTION OF DRAWINGS

A further understanding of the invention may be had by reference to the accompanying drawing in which:

FIG. 1 is a plan view of the preferred sanding pad of the invention in position on the hand;

FIG. 2 is a cross-sectional view of the sanding pad shown in FIG. 1 taken at line 2—2, without showing the hand and having a sheet of coated abrasive adhered on its face;

FIG. 3 is a cross-sectional view of another embodiment of the sanding pad of the invention; and FIG. 4 is a plan view of a portion of another embodiment of the pad of the invention.

DESCRIPTION OF THE PREFERRED EMBODIMENTS

Referring to the accompanying drawing, particularly FIGS. 1 and 2, in which like reference numerals refer to like parts, a sanding pad 10 is shown which comprises a conformable, self-supporting pad 12 having one major surface 13 capable of providing temporary adhesive attachment for a sheet 14 of pressure-sensitive adhesive-coated abrasive material and a handle means for maintaining the pad in contact with the hand of the user during use.

The pad may be of any shape or size convenient for holding in the hand. It has been found that sizes ranging in diameter (for a round pad) or on edge (for a pad having straight edges) of from about 3 to about 8 inches are quite adequate. The shape of the pad may be circular, as shown in the drawing, or any other convenient shape, including rectangular (e.g., square), triangular, teapezoidal and pear-shaped.

The conformable pad is at least about 1/32 inch thick, preferably at least ⅛ to ½ inch thick. The pad is formed of a material which is conformable and for the most part will conform easily around intricate and complex shapes, yet it has sufficient body and integrity to distribute the forces provided by the fingertips and palm. For convenient application of a pressure-sensitive coated abrasive sheet, the conformable pad should not be so conformable as to hang limp from the handle means. It may be difficult to apply the adhesive face of the abrasive sheet to a pad which is too limp.

Any of a wide variety of conformable sheet materials have been found to be suitable for forming the conformable pad of the sanding pad of the present invention. Useful materials include solid rubber sheets or sheets of open or closed cell foam rubber formed of natural rubber, silicone rubber, neoprene, nitrile rubber, SBR rubber, vinyl rubber, epichlorohydrin rubber, ethylene propylene diene terpolymer rubber, polyurethane rubber, and the like; sheets of reticulated material formed of thermoplastic materials such as polyvinyl chloride, polypropylene, polystyrene, and the like; nonwoven fabrics which may be formed of adhesively bonded staple fibers or of mechanically integrated fibers, e.g., felt; woven or knit fabrics; embossed-surfaced plastic material such as embossed films of polyvinyl chloride, polyurethane, polyethylene, polypropylene; natural sheet goods such as leather; and laminations of one or more of the above. A useful pad may be provided by a sheet of the loop-type fabric of the type employed for hook- and loop-type fastening material such as that sold under the trade designations "Velcro" or "Scotch-Mate". The preferred pad is formed of an elastic nylon fabric laminated to a foam rubber layer.

A particular conformable material to be employed as the pad in the sanding pad of the invention will be suitable, if it is sufficiently soft and conformable without being too limp. Useful sheet materials will have a flexural rigidity when evaluated using ASTM fabric stiffness test D 1388-64 (Option A-Cantilever Test) of at least 500 mg. cm., preferably at least 1000 mg.cm. Materials having a flexural rigidity less than 500 mg. cm. have been found to be too limp.

According to this test, a 25 by 150 millimeter test specimen is slid in a direction parallel to its long dimension so that its end projects from the edge of the horizontal platform until the length of the overhang is depressed under its own weight to a point where the line joining the tip of the edge of the platform makes an angle of 41.5 degree with the horizontal. The horizontal platform is at least 38 by 150 millimeters in area and has a smooth, low-friction, flat surface such as polished metal or plastic and is maintained in a level position as indicated by a bubble leveling device. One-half of this length is the bending length of the specimen. The cube of the bending length of the specimen multiplied by the weight per unit area of the fabric is the flexural rigidity.

The materials which are sufficiently soft and conformable will have a Shore A durometer hardness value of less than about 40. Harder materials will not be easily conformable to complex surfaces.

The surface of the pad is modified to prevent permanent adhesion of the pressure-sensitive adhesive coated-abrasive sheet material and to provide temporary attachment of the pressure-sensitive coated-abrasive sheet. Modification of the surface to provide other than a continuous planar surface has been found to prevent permanent adhesion and permit temporary adhesion. This may be accomplished by embossing the surface to provide surface undulations as shown in FIG. 4 or by other surface modification. For example, it has been also found to be advantageous to adhere to the surface a fabric material, such as woven or knit nylon, flocking material, or embedding glass beads in the pad surface. Other means of preventing permanent adhesion and promoting temporary adhesion are also possible. For example, the surface may be chemically or physically modified, e.g., by applying a coating typically employed in the tape industry as non- or weakly-adherent back-size coatings to a planar pad surface.

The handle means includes a flexible or rigid handle to be grasped by the hand or to be engaged with the hand and a fastening means to secure the handle to the back side of the conformable pad. The fastening means may be any convenient, compatible device. Useful fastening means include snaps, twist-lock or screw-type fasteners provided by separable mating segments or strips of engagable material such as those sold under the trade designation "Hedlok", "Velcro" and "Scotch-Mate". Other methods of fastening including adhesives, sewing, stapling and the like are also useful.

The handle can also be a single strip of cloth attached at one point which can be retained between the fingers of the user, or may be a more convenient form which fits over one or more fingers. An example of the latter includes a fabric strap 30 (preferably elastic) depicted in FIG. 3 which is sewn on the back side of foam pad 12. In such case, it is preferred to have a cloth facing 16 on the front side of the pad to provide a means of preventing the threads 17 from pulling out.

The most preferred handle means is provided by arrangement of three segments of hook- and loop-type fastening materials such as that sold under the trade designations "Velcro" or "Scotch-Mate". As depicted in FIG. 2, a strip 20 of the loop-type fastening material is adhesively bonded to the back side of the pad by a suitable adhesive 21. A ring 25 is then formed by overlapping the ends of a segment of loop-type fastening material and a segment 23 of hook-type fastening material so that a portion 24 of the hook-type fastener material is exposed on the outside of the ring. Ring 25 can then be conveniently engaged with the adhered loop-type material strip 20 on the back side of the pad. Ring 25 is of a size which will accommodate at least one finger of the user. The arrangement is most preferred because it permits easy separation and rotation of the pad 12 and its attached abrasive sheet about the point of attachment to prevent preferential areas of wear on the abrasive surface. It also provides an adjustable ring to accommodate different sizes of fingers of users. This type of handle means is preferred over the sewn strap type as depicted in FIG. 3 because the sewn strap type has a tendency to bow the pad as the fingers are inserted due to the extreme flexibility of the pad. This may be an advantage in some situations where a non-planar abrasive surface is desired.

The sanding pad of the invention may be modified without departing from the scope of the claims. For example, the resilient pad may include a tab portion 19 to facilitate separation of the abrasive sheet by merely displacing the tab with respect to the abrasive sheet which will cause the abrasive sheet to commence separating from the surface of the conformable pad.

What is claimed is:

1. A hand-held sanding pad comprising (1) a conformable, self-supporting pad at least about 1/32 inch thick having one major surface and an opposite major surface, said one major surface being capable of providing adhesive attachment for a sheet or pressure-sensitive adhesive-coated abrasive material during use yet permitting clean removal of said sheet after use, said pad being formed of a material which has a flexural rigidity of at least 500 mg. cm. and a Shore A durometer hardness value of less than 40;

(2) attached to said opposite major surface of said pad, handle means to maintain the pad in contact with the hand of the user during use, said handle means being provided by at least three segments of hook- and loop-type fastening material, with one segment of said fastening material being permanently attached to said opposite major surface and the other segments being temporarily engaged adjacent their ends to form a ring structure capable of accommodating at least one finger of the user and having on its outer surface a segment of material which is temporarily engaged with said attached segment to provide an attachable-detachable structure.

2. The sanding pad of claim 1 wherein said conformable, self-supporting pad is formed of a sponge rubber-fabric laminate wherein the fabric provides said one major surface capable of providing temporary adhesive attachment for a sheet of pressure-sensitive adhesive-coated abrasive material.

3. The sanding pad of claim 1 wherein said one major surface is embossed with a pattern to prevent permanent adhesion of said pressure-sensitive adhesive-coated abrasive material.

4. The sanding pad of claim 1 wherein said attached segment is provided by a strip of loop fastening material which is permanently attached to said opposite major surface and has temporarily engaged therewith a set consisting of at least one strip of loop fastening material and one strip of hook fastening material temporarily engaged adjacent their ends to provide said ring structure capable of accommodating at least one finger of the user and having an exposed segment of hook material on its outer surface for temporary engagement with the permanently attached loop material.

5. A hand-held sanding pad comprising (1) a highly conformable, self-supporting, resilient sheet of foam material at least 1/16 inch thick and having one major surface capable of providing temporary adhesive attachment for a sheet or peressure-sensitive adhesive-coated abrasive material; and (2) permanently adhesively bonded to the opposite major surface of said sheet of foam material, a strip of loop material of the type employed in hook-and-loop fastening devices and, temporarily engaged therewith, a set consisting of at least one strip of loop material and one strip of hook material temporarily engaged adjacent their ends to provide a ring capable of accommodating at least one finger of the user and having an exposed segment of hook material on its outer surface to provide temporary engagement with the permanently attached loop material.

* * * * *

UNITED STATES PATENT AND TRADEMARK OFFICE

CERTIFICATE OF CORRECTION

PATENT NO. : 4,202,139

DATED : May 13, 1980

INVENTOR(S) : IN SUN HONG and GLENN E. ROELOFS

It is certified that error appears in the above–identified patent and that said Letters Patent are hereby corrected as shown below:

In the Specification:

Col. 3, line 27, change "teapezoidal" to read --trapezoidal--.

In the Claims:

Col. 6, line 31, change "or" to read --of--.

Col. 6, line 32, change "peressure" to read --pressure--.

Signed and Sealed this

*Twenty-third* Day of *September 198*

[SEAL]

*Attest:*

SIDNEY A. DIAMOND

*Attesting Officer*

*Commissioner of Patents and Trademarl*